United States Patent [19]

Siler

[11] 4,202,135

[45] May 13, 1980

[54] DOLL

[76] Inventor: Ethel J. Siler, 4595 W. 4955 S., Kearns, Utah 84118

[21] Appl. No.: 883,357

[22] Filed: Mar. 6, 1978

[51] Int. Cl.[2] ..... A63H 3/14

[52] U.S. Cl. ..... 46/154

[58] Field of Search ..... 46/154, 158, 160

[56] References Cited

U.S. PATENT DOCUMENTS

| | | | |
|---|---|---|---|
| 1,269,363 | 6/1918 | Averill | 46/160 |
| 3,611,628 | 10/1971 | Noble et al. | 46/154 |
| 3,942,283 | 3/1976 | Rushton | 46/154 |

FOREIGN PATENT DOCUMENTS

| | | | |
|---|---|---|---|
| 345333 | 12/1921 | Fed. Rep. of Germany | 46/154 |

OTHER PUBLICATIONS

Puppet Doll, Women's Home Companion, 3-1952.

*Primary Examiner*—John F. Pitrelli
*Attorney, Agent, or Firm*—B. Deon Criddle

[57] ABSTRACT

A stuffed doll having a substantially rigid head and upper torso portion, legs hingedly connected at the lower end of the upper torso portion, lower finger receiving pockets at the rear of the legs and a common pouch extending across the open upper ends of the lower finger receiving pockets to form an upper finger receiving opening at the rear of the upper torso of the doll. Arms or other upper limb members are hingedly connected to the upper torso portion and with a leg, to move with the leg.

1 Claim, 4 Drawing Figures

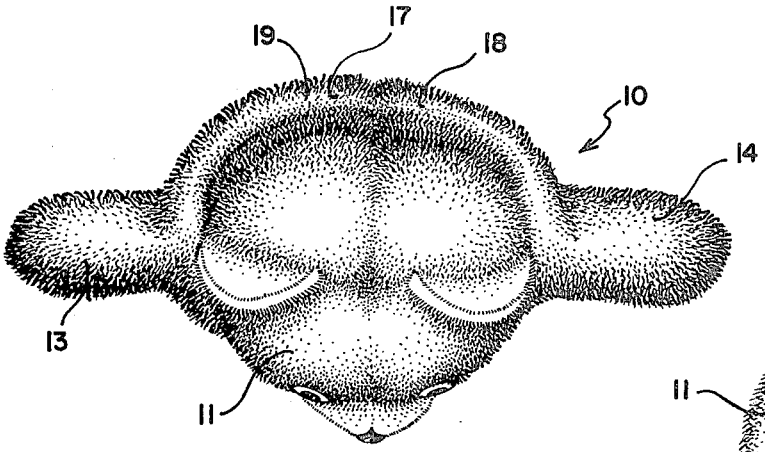
FIG. 1
FIG. 3
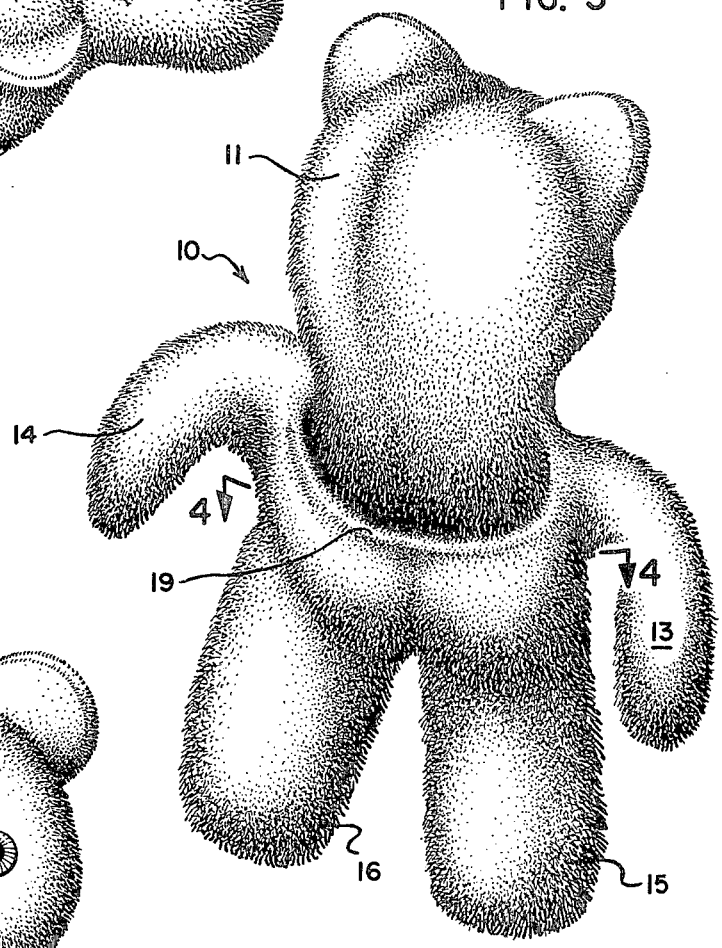
FIG. 2
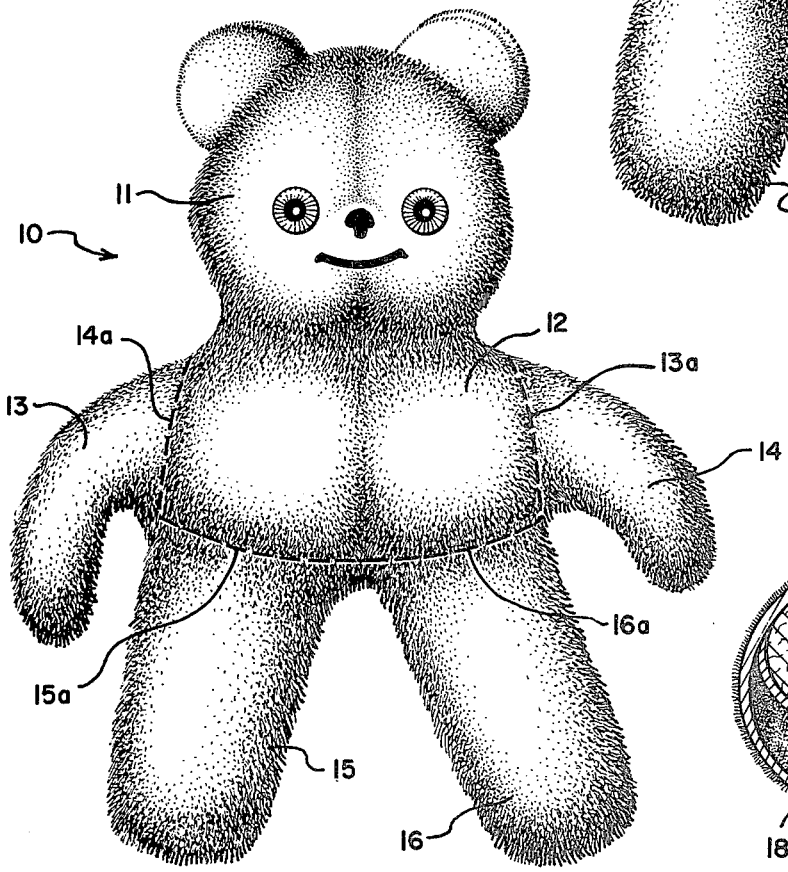
FIG. 4
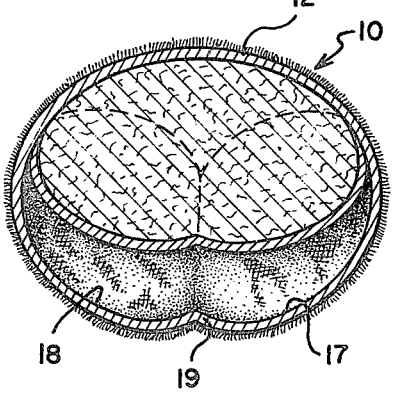

DOLL

BRIEF DESCRIPTION OF THE INVENTION

1. Field of the Invention

This invention relates to stuffed dolls and particularly to such dolls having movable body members.

2. Prior Art

Stuffed dolls have long been a favorite toy of children. Such dolls may take the form of a person, an animal or sometimes a strictly imaginary creature, but in any event they are a popular children's item.

Various kinds and types of dolls having movable body parts have also long been known. These include marionettes, puppets of various kinds, and mechanically operated dolls. While such movable types of dolls are often very appealing to youngsters, they are also generally expensive to purchase, and cannot be used easily by young children.

Principal objects of the present invention are to provide an animated doll that is relatively inexpensive to construct, that is safe to have around even very young children, and that can be readily used by even an unskilled person or a young child.

Principal features of the present invention include a body made of flexible sheet material, and preferably of a fabric material, and with the head and upper torso of the body being stuffed with a soft filler material to make them substantially rigid. Arms or other upper limb members are attached partially to the uppr torso member by a hinge connection and may also be made rather rigid through stuffing them with the soft filler material.

Legs or other lower limb members are connected to a lower portion of the upper torso member by means of a hinge connection and a lower finger receiving pocket is formed at the rear of each leg, with each such pocket having an opening at the top of each leg to receive the lower portion of a user's fingers.

A common pouch extends over the open ends of the leg pockets and opens upwardly to receive the upper portions of fingers inserted into the leg pockets.

Other objects and features of the invention will become apparent from the following detailed description and claims.

THE DRAWINGS

In the drawings:

FIG. 1 is a top plan view of a doll according to the invention;

FIG. 2, a front elevation view;

FIG. 3, a pictorial view taken from behind, to one side and slightly below the doll of FIGS. 1 and 2; and FIG. 4, a horizontal sectional view, taken on the line 4—4 of FIG. 3.

DETAILED DESCRIPTION

Referring now to the drawings:

In the illustrated preferred embodiment, the doll of the invention shown generally at 10, includes a head portion II, an upper torso body portion 12, a pair of arms or other such upper limb members 13 and 14; a pair of legs or lower limb members 15 and 16; leg pockets 17 and 18, and a pouch 19 that extends over and that is common to the upper ends of the leg pockets 17 and 18.

The head portion 11 is preferably substantially rigid with the upper torso portion so that they will move together, as will be further explained.

The upper limb members 13 and 14 are hingedly connected at 13*a* and 14*a* respectively, to the upper torso body portion 12. As shown, the vertical hinge connection 13*a* or 14*a* for each upper limb portion is made by sewing such limb portion to the upper torso body portion. The upper limb portions are also connected to the pouch 19, and as shown may be formed integral therewith.

The lower limb members 15 and 16 are also hingedly connected to the upper torso portion. As shown, the horizontal hinge connections 15*a* and 16*a* are made by sewing the lower limb portions to the lowermost edge of the upper torso body portion.

The leg pockets 17 and 18 are formed by sewing a piece of fabric to the back of each lower limb member 15 and 16 and, as shown, such fabric may be the same fabric used to form the pouch 19 and the back portions of the upper limb members.

In using the doll 10, a user will insert the tips of his first two fingers downwardly into the leg pockets 17 and 18. With the two fingers so inserted, the portions of the fingers above the second joints are positioned behind the upper torso body portion 12 of the doll. Thereafter movement of the two fingers by bending them at the second joint will impart a walking motion to the lower limb members 15 and 16 while the upper torso body portion 12 and head 11 are moved together with the portions of the fingers above the second joints and separately from the lower limb members. Such movement allows a lifelike animation of the dolls that has proven very appealing even to very young children.

While the doll shown is in the form of a bear character, it will be apparent that the design of the doll is a matter of choice and that the character can be representative of a human, an animal or any other real or imaginary creature.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A doll which may be manipulated by the insertion of a users fingers therein, comprising a head;

a upper torso body portion fixed to and movable with said head;

a pair of upper limb members hingedly connected to the upper torso body portion;

a pair of lower limb members, hingedly connected to a lower edge of the upper torso body portion;

a single piece of sheet fabric forming an upwardly opening leg pocket at the back of each lower limb member, a pouch extending over the open upper end of each leg pocket and upwardly adjacent a portion of the upper torso member above the lower limb members and a portion of the upper limb members, whereby manipulation of said lower limb members by the insertion of a users finger in said leg pockets thereof will simultaneously cause movement of said upper limbs thereof.

* * * * *